United States Patent [19]

Jeanson

[11] 4,242,816

[45] Jan. 6, 1981

[54] DREDGER HAVING A TWO-PART BOOM

[75] Inventor: René H. Jeanson, Auzay, France

[73] Assignee: Societe Anonyme Francaise du Ferodo, Paris, France

[21] Appl. No.: 915,884

[22] Filed: Jun. 15, 1978

[30] Foreign Application Priority Data

Jun. 23, 1977 [FR] France ..... 77 19280

[51] Int. Cl.[3] ..... E02F 3/88

[52] U.S. Cl. ..... 37/67; 37/72

[58] Field of Search ..... 37/67, 66, 64, 72, 58

[56] References Cited

U.S. PATENT DOCUMENTS

| | | | |
|---|---|---|---|
| 293,932 | 2/1884 | Angell | 37/72 X |
| 3,171,219 | 3/1965 | Kaufmann et al. | 37/67 X |
| 3,218,739 | 11/1965 | Kaufmann et al. | 37/67 X |
| 3,755,932 | 9/1973 | Cargile, Jr. | 37/67 |
| 3,800,949 | 4/1974 | Dural | 37/67 X |

FOREIGN PATENT DOCUMENTS

| | | | |
|---|---|---|---|
| 1229017 | 11/1966 | Fed. Rep. of Germany | 37/72 |
| 6918078 | 6/1971 | Netherlands | 37/67 |

*Primary Examiner*—Clifford D. Crowder
*Attorney, Agent, or Firm*—Young & Thompson

[57] ABSTRACT

The invention described consists of a dredger having a floating hull and a two-part boom attached to the hull and extending forwardly therefrom. The rear end of the first part of the boom is hinged to the hull about a horizontal axis, while its front end has a platform also hinged about a horizontal axis, with structure being provided to keep the platform horizontal when this first part of the boom is inclined using a jib and cable. On the platform is a component pivoted about a vertical axis and on this component is pivoted, about a horizontal axis, the second part of the boom, which performs a sweeping dredging movement and has at its front end a disintegrator tool, and the suction inlet of a pipe for removal of dredged material. The structure keeping the platform horizontal may be a mechanical parallelogram, or servo controlled jacks. Piles on the floating hull and on the platform serve to stabilize the dredger on the sea-bed.

4 Claims, 4 Drawing Figures

DREDGER HAVING A TWO-PART BOOM

BACKGROUND OF THE INVENTION

The present invention relates to a dredger comprising a floating body, a boom which extends forwardly and carries at its front end a disintegrating tool, the said boom being pivoted by its rear end on the floating body in such a manner as to be able to assume either a working position, in which it is dipped to a greater or lesser extent, or a raised position of rest, and further comprising suspension means for the boom enabling its position to be adjusted.

With dredgers of this kind it is usually the displacement of the floating body itself by means of piles and cables, known as swinging cables, associated with winches and having their ends anchored in the sea-bed, that makes it possible to dredge in an arc of a circle.

When it is desired to dredge in ports it is therefore necessary to remove the ships which would hinder this work. This evacuation is onerous and adds considerably to the cost of the dredging operation.

Another disadvantage of known dredgers of the kind indicated above is that they lack stability and efficiency when they are required to dredge a hard bed or to excavate rocks, because of their instability caused by reaction forces resulting from the action of the tool.

The present invention relates to a dredger which is exempt from these various disadvantages and which permits dredging with a large radius of action under floating obstacles, which need not be removed, while in addition this dredger permits excavation of rocks as well as dredging of soft or semi-hard beds, while it is of simple and strong construction.

SUMMARY

According to the invention the boom is composed of two parts, of which the first is pivoted by its rear end about a horizontal axis on the floating body, while a platform is mounted on the front end of the said first part of the boom and the second part of the latter is mounted on this platform for pivoting about a vertical axis.

According to another characteristic of the invention the platform is mounted for pivoting about a horizontal axis on the front end of the aforesaid first part of the boom, while in addition this platform is held horizontal in relation to the floating body by mechanical parallelogram connection means or by servo controlled jacks.

As a result of this arrangement, the forward end of the first part of the boom is brought close to the bed and dredging is effected by causing the second part of the boom to perform a sweeping movement, thus effecting dredging by swinging the second part of the boom without it being necessary for the floating body to be used; this swinging movement of the second part of the boom is in fact achieved by means inside the dredger without it being necessary to make use of external means such as cables and anchors. It is thus possible to dredge the bed under floating obstacles, particularly in a port, the floating body being placed between two rows of ships, while it is the second part of the boom which, by its swinging movement, operates freely under the ships.

According to another characteristic of the invention the second part of the boom is mounted for pivoting on the platform via a component, mounted on the platform for rotation about the aforesaid vertical axis, while the second part of the boom is articulated on this intermediate component for pivoting about a horizontal axis, regulation means, such as jacks, being provided to move the second part of the boom so as to bring it horizontal with, or at an angle to, the platform, depending on the work which is to be done.

According to another characteristic of the invention, the second part of the boom is so constructed that its total specific gravity is close to that of water, in such a manner as to apply no substantial action in the water either in the downward direction or in the upward direction, this characteristic being of particular interest because it makes it possible to avoid any change of stability of the dredger as a whole during the dredging operation.

According to yet another characteristic of the invention, the floating body comprises at least two piles which are anchored in the bed to be dredged during the dredging work and which make it possible to fix the position of the floating body, while the previously mentioned platform is also associated with a load distribution plate which may advantageously be equipped with piles for anchoring it to the bed.

This arrangement makes it possible for the platform to be made extremely stable in relation to the bed. Consequently, the dredger can be used for rock excavation without any risk of impairing the stability of the floating body.

DESCRIPTION OF THE PREFERRED EMBODIMENTS

Figure 1:
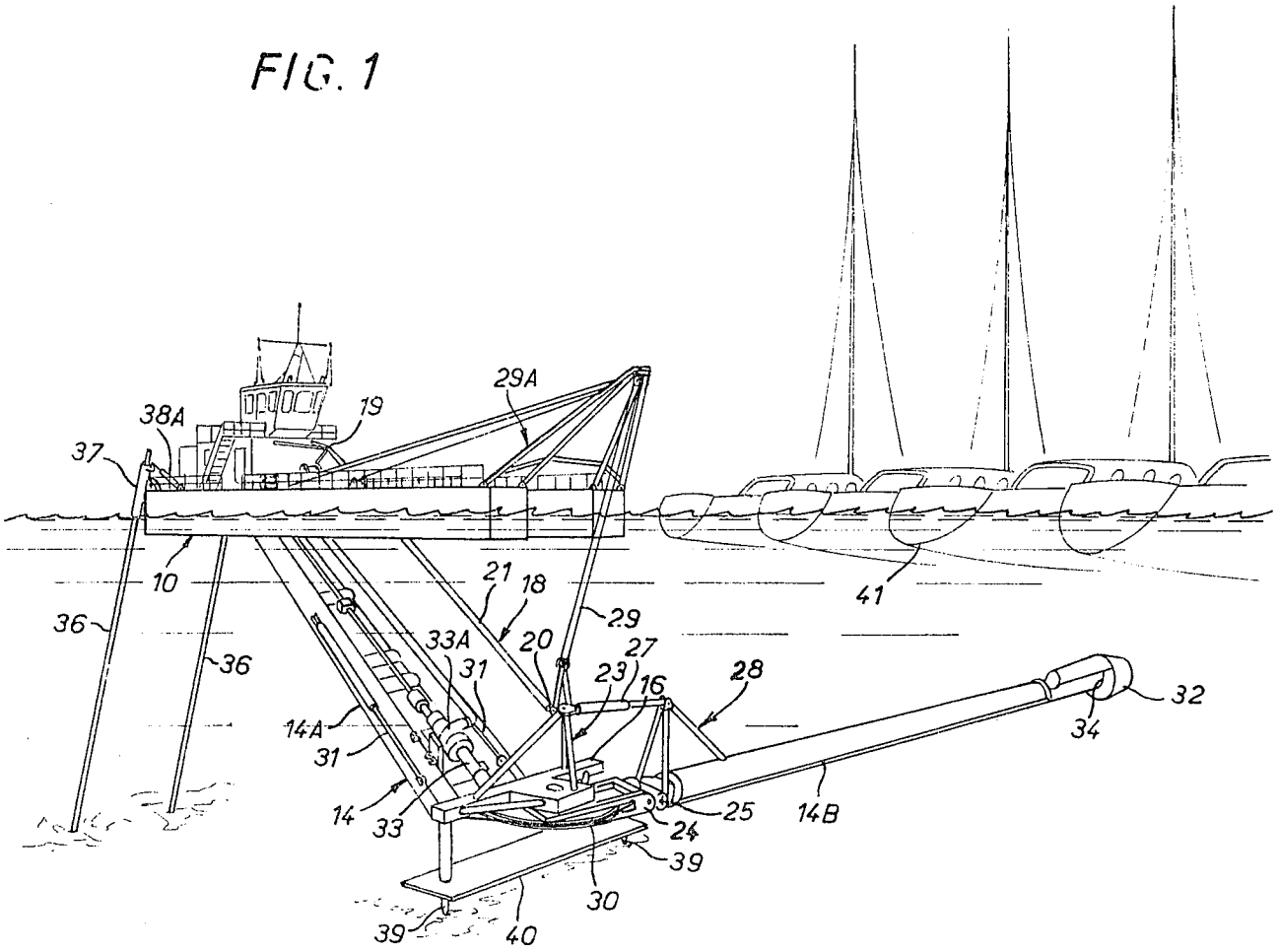
FIG. 1 is a general diagrammatical view in perspective of a dredger according to the invention.
Figure 2:
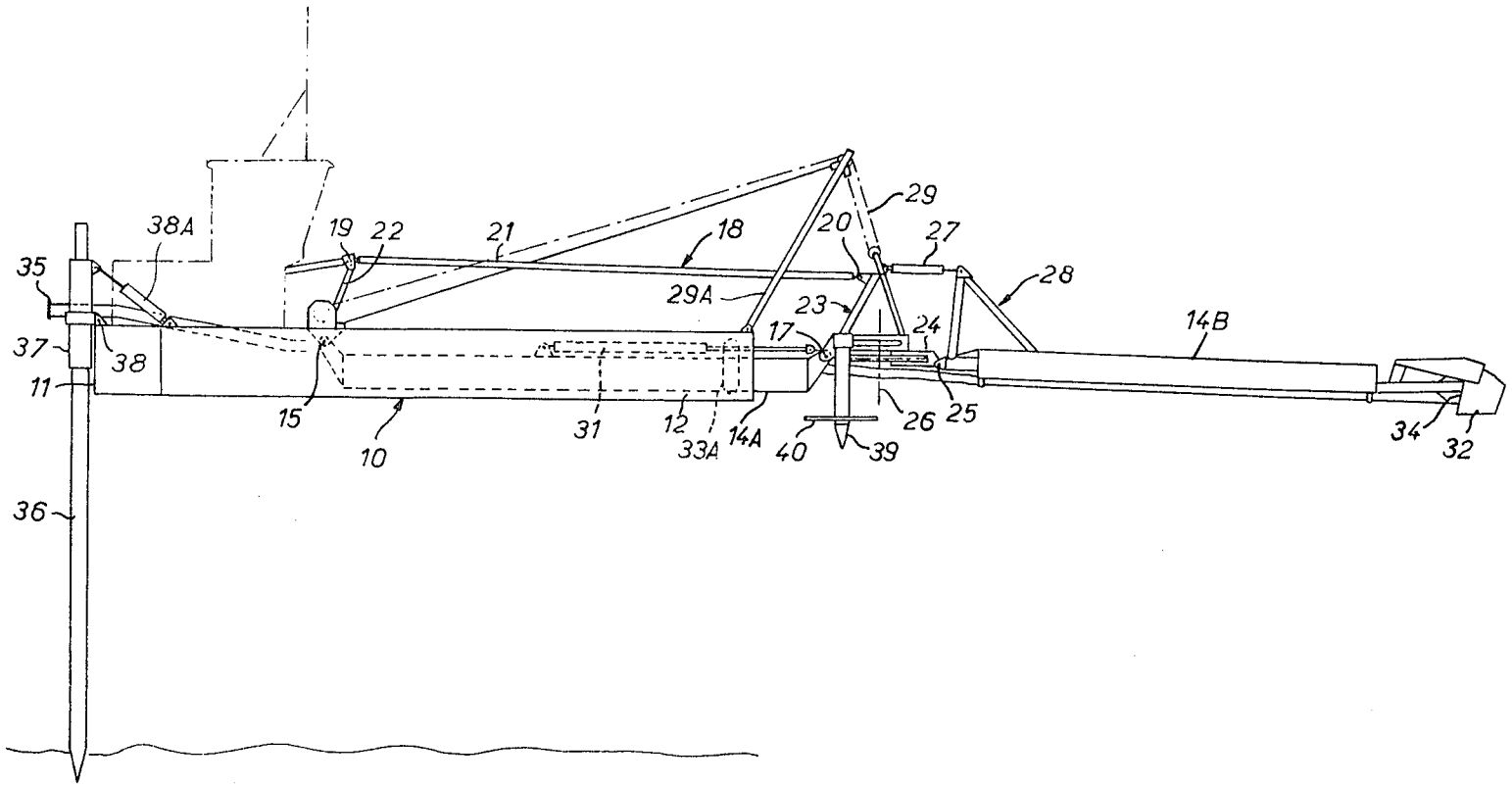
FIG. 2 is a view in elevation of this dredger with the boom raised.
Figure 3:
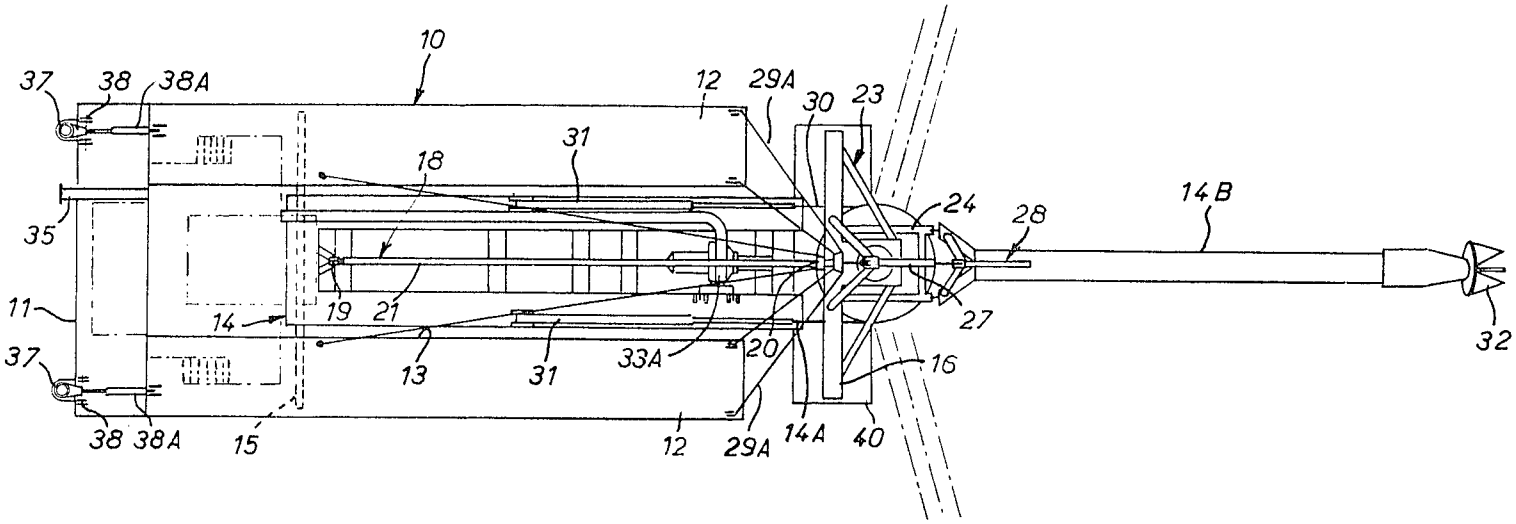
FIG. 3 is a plan view of the dredger.
Figure 4:
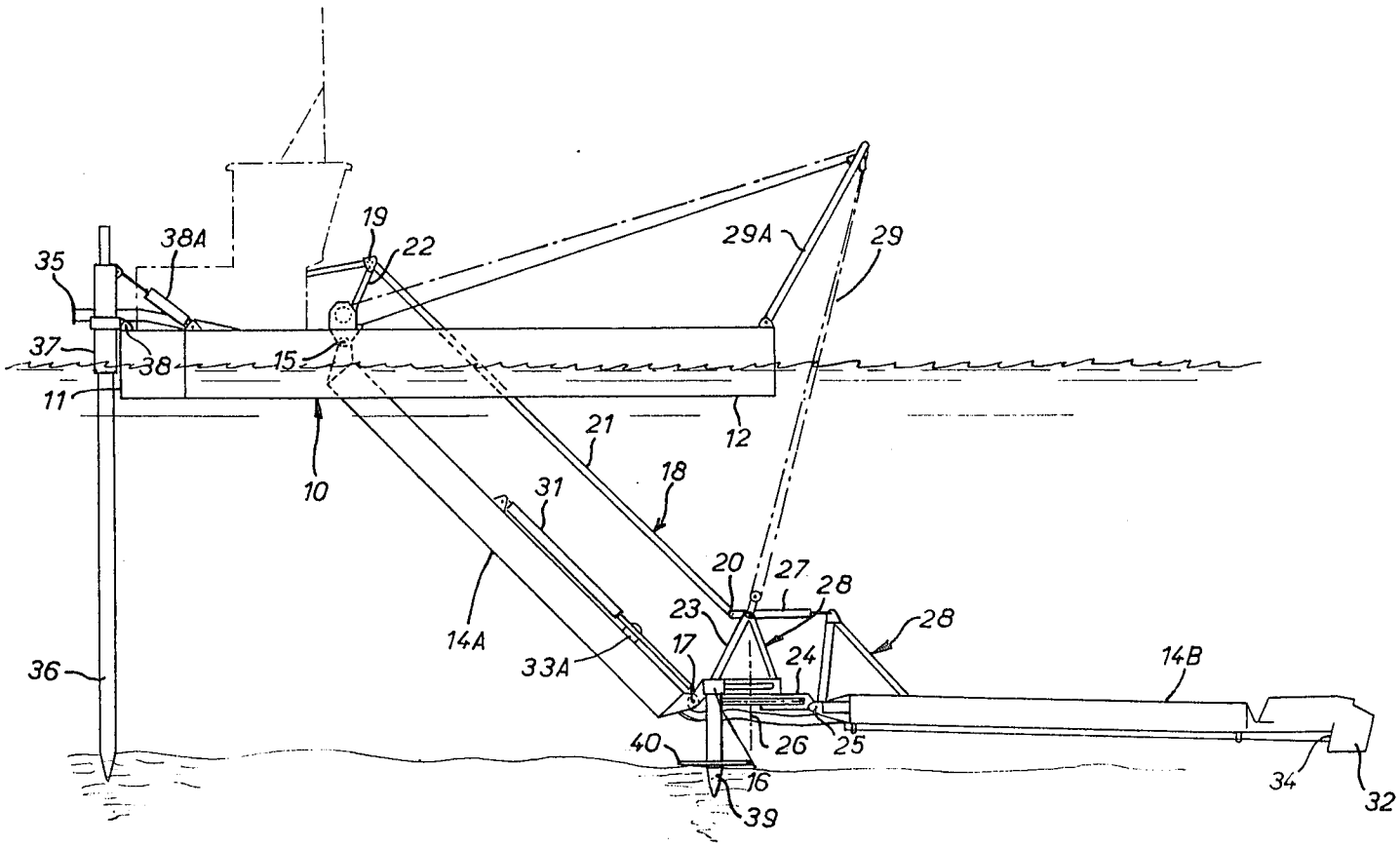
FIG. 4 is a similar view to FIG. 2 but showing the boom lowered in the working position.

In the embodiment illustrated a dredger comprises a floating body in the form of a hull 10 which is generally U-shaped in plan and whose base 11 is situated at the rear, while the two branches 12 extend forwardly and form between them a central free space 13.

A boom 14 is composed of two parts 14A and 14B. The first part 14A of the boom is mounted by its rear end on the floating hull 10 for pivoting about a transverse horizontal axis 15. The latter is in turn situated at the rear of the floating hull 10. The part 14A of the boom is movable into and out of the space 13.

A platform 16 is mounted on the front end of the first part 14A of the boom for pivoting about a horizontal axis 17. The platform 16 is held constantly horizontal by mechanical parallelogram connection means 18 or, in an alternative embodiment, by servo controlled jacks which are not shown in the drawings.

More particularly, the parallelogram of these connection means has two apices coinciding with the axes 15 and 17, while the other apices of this parallelogram are at 19 and 20. The side separating the apices 15 and 17 is constituted by the part 14A itself. The opposite side joining the apices 19 and 20 is constituted by a rod 21, while the other sides are respectively constituted on the one hand by a rod 22 joining the apices 15 and 19 and on the other hand by a tripod 23 fastened to the platform 16 and joining the apices 17 and 20.

The second part 14B of the boom is articulated on a mounting, in the form of an intermediate component 24, about a horizontal axis 25. The intermediate component 24 is in turn mounted on the platform 16 for pivoting about a vertical axis 26. Adjustment means, such as a jack 27, are interposed between a tripod 28, fastened to the second part 14B of the boom, and to the tripod 23, fastened to the platform 16. The jack 27 is of the double-acting type and it enables the second part 14B of the boom to be held horizontal or to be given any inclination, and yet the jack can absorb any force of reaction resulting from the action of a disintegrator tool 32.

The tripod 23 is connected to the floating body 10 by suspension means comprising a cable 29 and a jib 29A. These suspension means make it possible for the entire boom 14A, 14B either to be held in a horizontal plane or to be lowered towards the bed which is to be dredged, with the part 14A inclined and the part 14B substantially horizontal.

The intermediate component 24, which is mounted on the platform 16 for pivoting about the vertical axis 26, is controlled in respect of rotation by a pair of cables 30 associated with operating means such as single-acting jacks 31 mounted on the first part 14A of the boom. Instead of the jacks 31, it is possible to use winches (not shown).

The disintegrator tool 32 is mounted at the end of the second part 14B of the boom and is driven rotationally by any suitable means.

For the removal of material a pick-up pipe 33 is provided and has a suction inlet 34 near the disintegrator tool and a discharge outlet 35 situated at the rear of the floating hull 10. The pipe 33 is provided with a motor-pump unit 33A mounted on the first part 14A of the boom.

The floating hull 10 is provided with anchoring piles 36 (two piles in the example illustrated) which enable the floating hull 10 to be fixed in position in relation to the bed. Each anchoring pile 36 is mounted for lockable sliding in a sleeve 37, which in turn is mounted on the floating hull 10 for lockable pivoting about a horizontal axis 38 by means of jacks 38A.

In addition, the platform 16 is attached to a load distribution plate 40 which may advantageously be provided with piles 39 for anchoring it in the bed.

The two parts 14A, 14B of the boom 14 are provided with buoyancy caissons and adjustable ballasting means (not illustrated) so as to enable the boom assembly 14A, 14B to be arranged to float on the surface and to give each of the parts 14A and 14B of the boom the most suitable total specific gravity. In particular, provision is made for giving the second part 14B of the boom a specific gravity close to that of water.

For operating purposes, the dredger is brought into position by towing, whereupon the two piles 36 are released and are anchored in the bed by their own weight; when this operation has been completed and load distribution plate 40 is laid on the bed, whereupon the two piles 36 are locked in relation to the floating hull. The dredger is then ready to operate, and for this purpose the second part 14B of the boom, which constitutes a sweeping part, is caused by the action of the jacks 31 to describe an arc of a circle defining a dredging front for the tool 32. A plurality of passes may optionally be made in order to remove the layer which is to be dredged.

It will be noted that distance indicators placed respectively on the second part of the boom, on the vertical axis of rotation of the intermediate component with respect to the platform, and on the first part of the boom will throughout the operation supply the operator in his cab with information regarding the inclination and the angular position of the second part of the boom and also with regard to the working depth. When the dredging depth has been reached, the dredger must perform a movement of advance. In order to do this, the second part 14B of the boom is raised by means of the jack 27, thus enabling this part of the boom to be disengaged from the bed, and then the two parts of the boom are subsequently raised so that the load distribution plate 40 will no longer be anchored in the bed.

The anchoring piles 36 are then unlocked at their connection to the respective sleeves 37 and are inclined by means of the associated jacks 38A, which has the effect of advancing the dredger a certain distance depending on the inclination given to the piles 36.

The load distribution plate 40 is then placed on the bed again, whereupon the piles 36 are locked and once again the part 14B of the boom can be swung again to perform a sweeping movement for a new dredging operation. It should be observed that when the anchoring piles 36 have the maximum inclination permitted by the inclining jacks the piles must be straightened so as to occupy a vertical or substantially vertical position; for this purpose the piles are unlocked and then raised one after the other and brought into the vertical position, an operation which may advantageously be carried out while the load distribution plate 40 is anchored.

It should be noted that the second part 14B of the boom can operate under floating obstacles such as ships 41 in a port, without it being necessary for these ships to be removed.

It will also be appreciated that anchoring of the floating hull 10 in relation to the bed with the aid of the piles 36 and 39 makes it possible to operate the tool 32 on very hard beds and in particular to effect rock excavation without any risk of jeopardizing the stability of the floating hull 10.

I claim:

1. A dredger comprising a floating body, a two-part boom having a raised, rest position and submerged, operative position and including a first boom part pivotally mounted at its rear end about a horizontal axis on said floating body and a second boom part having at its front end a disintegrating tool, a platform disposed between the front end of said first boom part and the rear end of said second boom part, means for maintaining the platform horizontal, means pivotally mounting the rear end of said second boom part on said platform about a vertical axis, said second boom part extending in its raised, rest position substantially entirely outwardly beyond the longitudinal confines of the floating body so as to enable the disintegrating head to operate beneath floating obstacles in its submerged, operative position, means mounting the rear end of said second boom part on said platform for vertical swinging movement relative to said platform about a horizontal axis, and means for adjusting the angle of said second boom part relative to said platform between a horizontal position and other positions of inclination.

2. A dredger according to claim 1, further comprising means for pivotally mounting said platform about a horizontal axis on the front end of said first boom part.

3. A dredger according to claim 1, wherein said means for maintaining said platform horizontal comprises a mechanical parallelogram linkage including said first boom part.

4. A dredger according to claim 1, wherein the specific gravity of said second boom part is close to that of water.

* * * * *